US005435762A

United States Patent [19]

Reuter

[11] Patent Number: 5,435,762

[45] Date of Patent: Jul. 25, 1995

[54] DRIVE UNIT FOR WATERCRAFT

[75] Inventor: Reinhold Reuter, Schwall, Germany

[73] Assignee: Schottel-Werft, Josef Becker GmbH & Co. KG, Spay, Germany

[21] Appl. No.: 132,780

[22] Filed: Oct. 6, 1993

[30] Foreign Application Priority Data

Oct. 7, 1992 [DE] Germany ..... 42 33 662.7

[51] Int. Cl.[6] ..... B63H 5/125

[52] U.S. Cl. ..... 440/54

[58] Field of Search ..... 440/54, 53; 114/151

[56] References Cited

U.S. PATENT DOCUMENTS 2,302,795 11/1942 Noble ..... 440/54

4,274,827 1/1981 Catsburg ..... 440/54

*Primary Examiner*—Sherman Basinger

*Attorney, Agent, or Firm*—Levine & Mandelbaum

[57] ABSTRACT

Propulsion unit for watercraft, with a drive shafting (3) between a drive motor (2) and a propulsive device (1), wherein this propulsion unit with vertical drive shafting is arranged in the shaft-like housing (12) of the hull (14) such that the distance between the motor and the propulsive device is adjustable. The motor (2) acts on the drive shafting (3) via a disengaging coupling (19), and is adjustable in the horizontal plane between two end positions when the coupling (19) is disengaged, wherein the motor (2) and the drive shafting (3) can be coupled with one another in one end position, and the drive shafting (3) with the propulsive device (1) associated with it can be moved past the motor in the other end position of the motor (2).

20 Claims, 2 Drawing Sheets

DRIVE UNIT FOR WATERCRAFT

BACKGROUND OF THE INVENTION

The propeller has been known to be arranged vertically adjustably in watercraft intended for transportation in shallow waters. During travel in water of sufficient depth, the propeller operates in a depth of water that is optimal from the viewpoint of the overall situation, while the propeller is adjusted in the upward direction during travel in correspondingly shallow water to the extent that it is still able to bring about propulsion, but contact with the bottom is ruled out, and when the watercraft is in extremely shallow waters, the propeller is even adjusted in the upward direction to the extent that it is located above the deepest point of the hull.

The so-called rudder propellers are a special type of boat propulsion. In the case of rudder propellers, the propeller is used not only to generate the propulsive force needed for moving the boat, but it is also pivotable such that the direction of the action of the propulsive force, i.e., not only the speed of travel, but also the direction of travel can be determined.

The following design has been known if a rudder propeller unit is used in a watercraft that is intended for transportation in shallow waters. In view of the small depth of water, the hull has a flat, level bottom. A shaft-like housing ("container") led out of the interior of the boat opens in the plane of this flat boat's bottom, and the propeller is mounted adjustably in the axial direction (in the longitudinal direction of the housing) in this housing. To cause the boat to travel in a defined direction, the propeller is located under the plane of the boat's bottom outside the shaft-like housing, and it is driven by a drive shafting, on the top end of which a drive motor acts, and whose lower end acts on the propeller, and which is led through this housing coaxially to the shaft-like housing. When the boat is in extremely shallow waters, the propeller is adjusted in the upward direction in relation to the shaft-like housing, and into the housing, if necessary. By rotating the propeller around the longitudinal axis of the drive shafting, it is possible to preset the direction of travel for the movement of the boat.

Even though the present invention does not pertain exclusively to such a propulsion, problems of such a propulsion are mainly discussed preferably and in connection with the explanation of the present invention.

If the rudder propeller, the drive shafting, and the drive motor at the top end of the drive shafting form, in their entirety, an assembly that is adjustable in relation to the shaft-like housing in a rudder propeller unit with propeller adjustable in the longitudinal direction of the drive shafting, all kinds of problems occur, which develop when large masses are to be adjustable: High adjusting forces are to be applied, and the accuracy of adjustment to be required can be achieved only with considerable effort. In addition, a relatively large free space in the hull is necessary in rudder propeller units, and this free space must be available above the motor when the unit is in its lower end position, and into which the unit is adjusted, especially with the motor, when the unit is to be adjusted in the upward direction from its lower end position, and this free space is lost as a useful space for boat cargo or the like. Even though this problem is alleviated when the motor is permanently installed in the hull and the drive shafting is designed as a longitudinally adjustable drive shafting by nonrotatably connecting, e.g., a motor-side drive shaft part and a propeller-side drive shaft part via spline shaft teeth. However, this solution also requires a relatively long and correspondingly heavy shaft-like housing, whose length is determined by the maximum length of the longitudinally adjustable drive shafting, namely, when the propeller has been maximally extended from the housing, i.e., when the maximum distance is present between the motor and the propeller.

SUMMARY OF THE INVENTION

The task of the present invention is to show a possible remedy, i.e., to make it sufficient to use a shaft-like housing which can be shorter than in prior-art solutions.

The solution to this task, i.e., the present invention, will become apparent from the patent claims, and will be explained below on the basis of the drawing.

DESCRIPTION OF THE PREFERRED EMBODIMENTS

Figure 1:
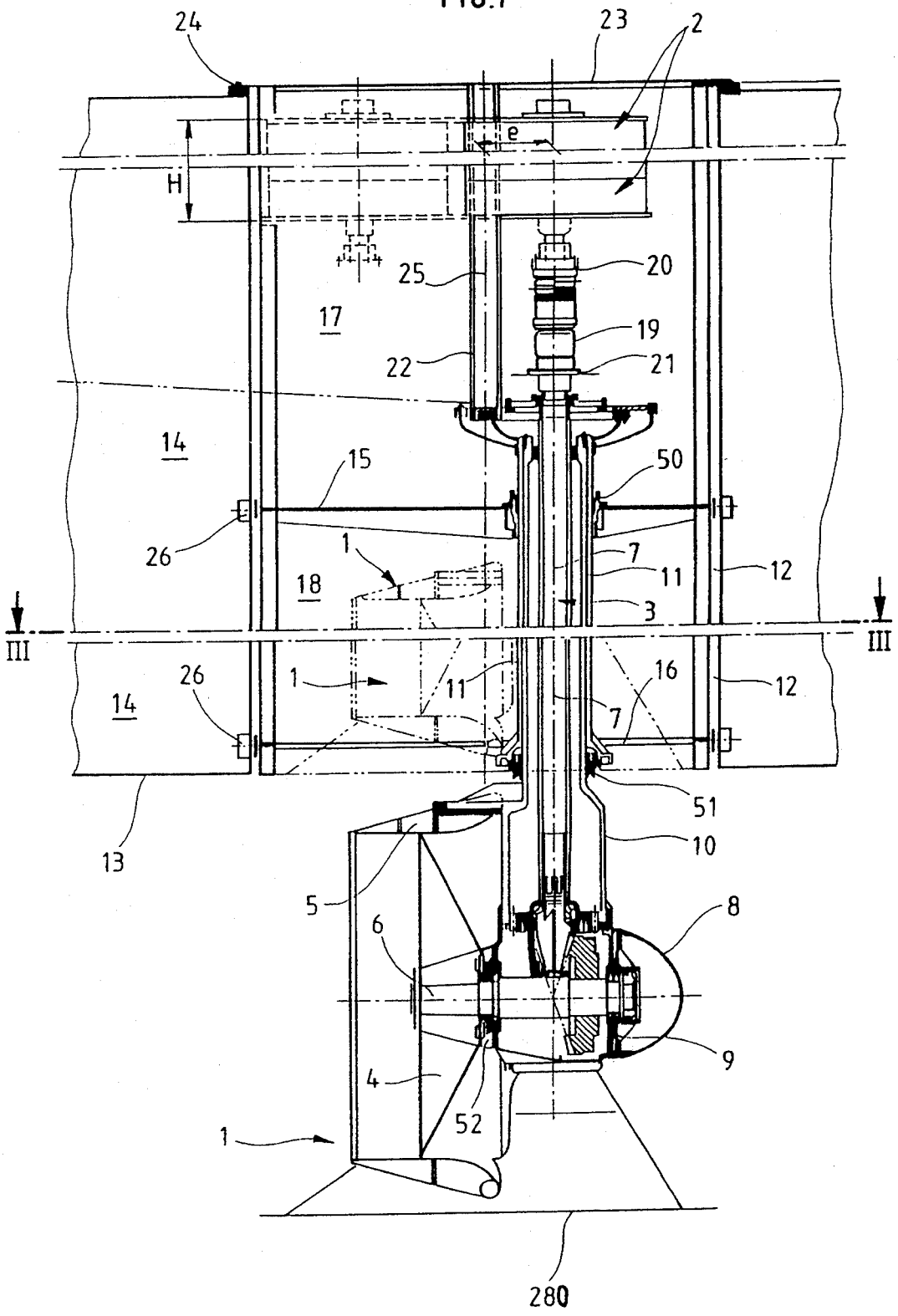
FIG. 1 shows a central longitudinal section through a propulsion unit according to the present invention.

The principal assemblies of the rudder propeller unit are, inasmuch as they are essential in connection with the present invention, the rudder propeller 1, the drive motor 2, and the vertical drive shafting 3 between the said drive motor 2 at the top end of the said drive shafting 3 and the said rudder propeller 1 at the lower end of the said drive shafting 3. The propeller 4 is arranged in a nozzle housing 5. The propulsive force for a boat, with which the unit is associated, is brought about by rotating the said propeller 4 around its longitudinal axis 6. The direction of travel of such a boat can be changed by pivoting the said rudder propeller 1 around the longitudinal axis 7 of the said drive shafting 3, and therefore the said rudder propeller 1 is pivotable by 360° around the said longitudinal axis. To do so, the housing 8 of the underwater gear mechanism 9 of the said rudder propeller 1 is connected to a tube 10, which surrounds the said drive shafting 3 and is arranged, forcibly pivotably around the said longitudinal axis 7, in a jacket tube 11, which in turn is held nonrotatably and nondisplaceably in the shaft-like housing 12. This housing is part of the hull, is permanently integrated in it, and is positioned such that its lower, rudder propeller-side end is located in the plane of the bottom 13 of the hull 14, with which the propulsion unit is associated. The said jacket tube 11 is held in the said housing 12 by a plurality of arms 15, 16, of which said arms 15 are integrated into a fluid-tight ring, which surrounds the said jacket tube 11 at the inner circumference in a fluid-tight manner, and is held in the said housing 12 in a fluid-tight manner at the outer circumference, and which thus divides the interior space of the said housing into an upper, "dry" housing chamber 17 and a lower, "wet" chamber 18, which communicates with the water in which the said propeller 4 operates.

A gland 50 is used to ensure the fluid-tight passage of the said jacket tube 11 through the said ring 15. The penetration of water into the annular space between the said jacket tube 11 and the said tube 10 is used as the fluid-tight design of a pivot bearing 51 at the lower end of the said jacket tube 11 between this and the said tube 10 Water is finally prevented from penetrating into the said tube 10 by the lower end of the said tube 10, which is open at both ends, but is otherwise fluid-tight, being connected to the said housing 8 of the said underwater gear mechanism 9, which is fluid-tight per se and from which the said propeller shaft 6 is in turn led out in a fluid-tight pivot bearing 52. At least the said ring 15, but possibly even the said arms 16 are supported via guide rollers 27 at the inner wall of the said housing 12, and they are prevented from rotating when quick-acting closures 26 are closed when the propulsive means is located in the lower end or working position, but the blocking of rotation can be released when the propulsive means is to be withdrawn into the said housing 12, for which purpose the entire unit consisting of the said propulsive means 1 and the said drive shafting 3, including the said tube 10, the said jacket tube 11, and at least the said ring 15 are to be adjusted in the upward direction, with the said motor 2 pivoted into its non-operating position (broken lines in FIG. 1).

While the lower end of the said drive shafting 3 and the lower end of the said tube 10 are led out of the lower end of the said jacket tube 11 below the said ring 15, the upper end of the said drive shafting 3 is led out of the upper end of the said jacket tube 11 above the said ring 15, without this arrangement needing to be fluid-tight. The said drive shafting 3 is connected to the driven shaft 20 of the said motor 2 via a disengaging coupling 19, so that the said drive shafting as a whole consists of the said drive shafting 3 proper and the said driven shaft 20 of the said motor 2 and can be driven by the said motor 2 when the said coupling 19 is engaged. A housing 21 accommodates a disk brake between the said coupling 19 and the said drive shafting 3.

The said motor 2 is an electric motor, whose housing is arranged on an axle journal 22, which is held coaxially to the said housing 12 on a housing cover (23) and extends into the said shaft-like housing 12. The said cover 23 is a multi-perforated disk, which is supported with its edge on an upper, outwardly directed ring flange 24 of the said housing 12 via the intermediary of an elastic ring, wherein a detachable connection is brought about with screw connections distributed on the circumference.

The said axle journal 22, arranged coaxially to the longitudinal axis 25 of the said shaft-like housing 12, and the said longitudinal axis 7 of the said motor driven shaft 20 and of the said drive shafting 3, as well the longitudinal axis of the said motor 2, when this is in the operating position, are arranged offset laterally by the amount "e" to the said longitudinal axis 25 of the said housing 12.

When the said motor 2 is in the operating position, in which it is represented by solid lines in FIG. 1, the said coupling 19 is engaged, and the said motor 2 is able to rotate the said propeller 4 around its longitudinal axis 6 via the said drive shafting 3. In this operating position, the said rudder propeller 1 is located outside the said housing 12 and under the said boat's bottom 13. The said rudder propeller is represented by solid lines in FIG. 1 in this position. It can be pivoted by defined rotation of the said tube 10 around its said longitudinal axis 7 in order to impart a desired direction of travel to the watercraft.

If the said rudder propeller 1 is to be adjusted in the upward direction and to be withdrawn into the said shaft-like housing 12 because the depth of water under the said boat's bottom 13 is too low, as is represented by broken lines in FIG. 1, the said coupling 19 is disengaged, so that the drive connection between the said motor 2 and the said drive shafting 3 is interrupted. The said motor 2, including the said shaft section 20, can subsequently be pivoted on the said axle journal 22 around the said longitudinal axis 25 of the said axle journal 22 into the out-of-operation position, as is shown by broken lines in FIG. 1. In this position of the said motor 2, the said drive shafting 3 can be adjusted in the upward direction, past the said motor 2, and the entire arrangement is designed such according to the present invention such that the said rudder propeller 1 is located completely above the said boat's bottom 13 (FIG. 1, broken lines), even though the said drive shafting 3 does not project above the said housing 12 in the upward direction, the said drive shafting 3 and the said motor 2 are located within the said shaft-like housing, and the said motor 2 and the said drive shafting 3 are located next to each other in the said shaft-like housing 12 in the area of the upper end, i.e., the entire adjusting or rudder propeller drive and the said shaft-like housing 12 can be built lower by the height H of the said motor 2 compared with prior-art solutions, and no additional space must be kept free above the said rudder propeller drive in the hull.

The pivoting movement of the said rudder propeller 1 around the said longitudinal axis 7 of the said drive shafting 3 can take place in the usual manner, so that this will not be discussed in greater detail here.

The said coupling 19 may have any purposeful design, so that this will not be discussed in detail here, either.

The pivoting movement of the said motor 2 around the said axle journal 22 and with the now rotatably mounted axle journal 22 around its said longitudinal axis 25 can also take place in any suitable manner, so that this does not have to be discussed in greater detail here, either.

Figure 2:
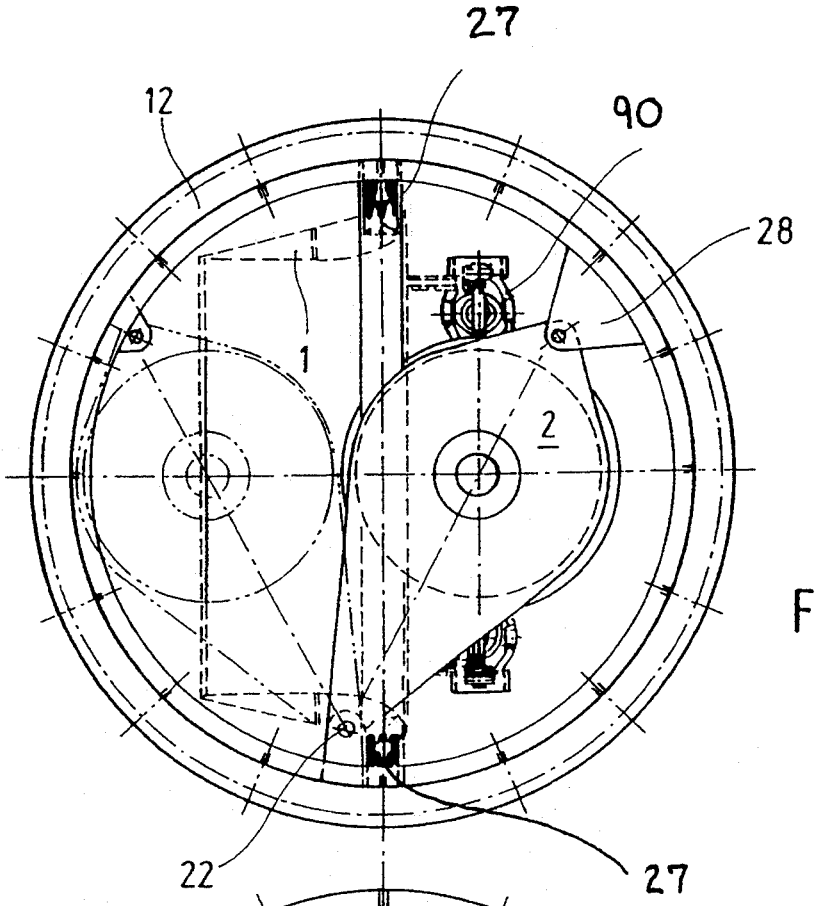
FIG. 2 shows a top view of the propulsion unit shown in FIG. 1.
Figure 3:
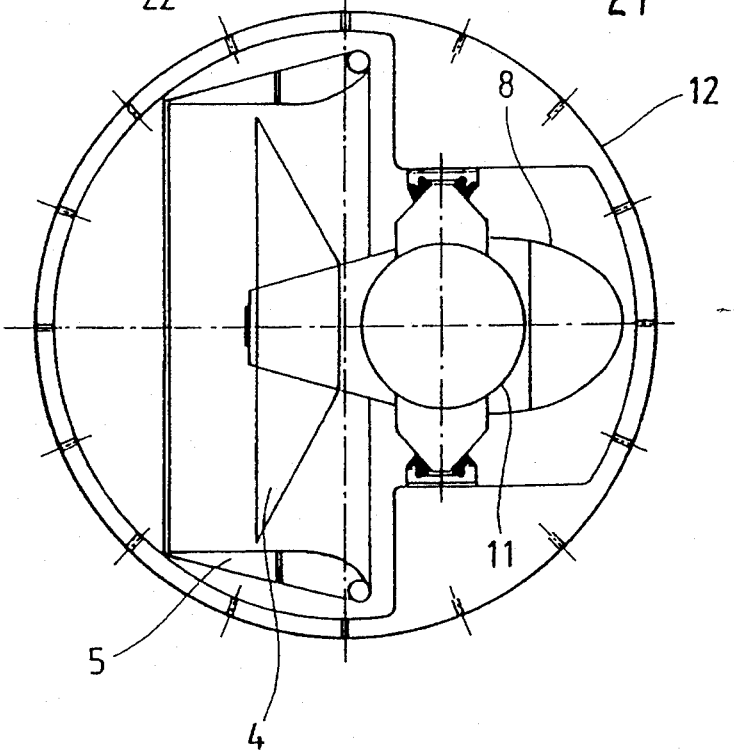
FIG. 3 shows a section along line III—III in FIG. 1.

This also applies to the vertical adjustment Of the said propulsive means between its two end positions, in which this can be brought about in any suitable manner. FIG. 2 schematically shows a hydraulic adjusting device 90 with pistons and cylinders that are hydraulically adjustable in relation to one another, but a mechanical adjusting means, e.g., a worm drive or a rack-and-pinion gear, is also possible.

The said motor 2 shall preferably be an electric motor, because its connections have proved to be particularly advantageous for the pivotable motor. It can be fixed by locking mechanisms 28 on the said cover 23 in its two end positions.

One rather important aspect is the possibility of removing the assembly consisting of the said propulsive means 1, the said drive shafting 3, and the said motor 2, while the said shaft-like housing 12 remains in the watercraft. The requirements for this are that the inner wall of the said housing 12 has no tapering from bottom to top; that the connection means between the said radial arms 15, 16 are detachable; that the said cover 23 with the said axle journal 22 attached to it can be removed from the said housing 12 in the upward direction; and, finally, that the internal diameter of the said housing 12 is larger than the horizontal extension of the said propulsive means 1 if the said assembly 1–3 is to be able to be removed in the upward direction.

For removal, if these requirements are met, the said plate 23 with the said axle journal 22 is removed in the upward direction. The connection means between the said radial arms 15, 16 and the said housing 12 are then removed, and the said assembly 1–3 can be removed in the upward direction, and the movement of the said rollers 27 contributes to the tilting during the upward movement in the said housing 12.

Removal in the downward direction is possible, in principle, and if only this possibility is provided, the condition that the internal diameter of the said shaft-like housing (12) must be larger than the horizontal extension of the said propulsive means 1 need not be satisfied.

When the said propulsive means 1 has been withdrawn into the said shaft-like housing 12, the said shaft-like housing can be closed on its underside in the plane of the said flat bottom 13 of the watercraft by a cover or a closing plate 28, so that the said flat bottom 13 of the watercraft displays no interruption.

I claim:

1. In a propulsion unit for a watercraft having a hull, said propulsion unit having a drive motor, propulsive means for propelling said watercraft along the water, drive shaft means connected between said drive motor and said propulsive means for imparting torque from the motor to the propulsive means, a cylindrical housing mounted within the hull of said watercraft, the improvement comprising means for mounting said motor for horizontal movement relative to said drive shaft means, and coupling means mounted between said motor and said drive shaft means for selectively engaging and disengaging said motor and drive shaft means, whereby the motor is in engagement with the drive shaft means in a coupled position, and the motor, can be horizontally displaced from the drive shaft means and propulsive means in an uncoupled position to permit vertical movement of the drive shaft means above the motor.

2. Propulsion unit in accordance with claim 1 wherein the lateral distance between the motor and the drive shaft means in the uncoupled position is greater than the external diameter of the drive shaft means and smaller than the horizontal length of the propulsive means.

3. Propulsion unit in accordance with claim 2, wherein the motor is mounted pivotably in the horizontal direction on a vertical axle journal and the longitudinal axes of the axle journal and of the drive shaft means are laterally offset in relation to one another.

4. Propulsion unit in accordance with claim 3, wherein the propulsive means is located within the housing in the uncoupled position, and outside the housing in the coupled position.

5. Propulsion unit in accordance with claim 4, wherein the propulsive means-side end of the housing is located in the plane of the bottom of the watercraft.

6. Propulsion unit in accordance with claim 5, wherein said means for mounting said motor for horizontal movement comprises mechanical means for enabling pivoting of the motor.

7. Propulsion unit in accordance with claim 6, wherein the coupling is integrated in the drive shaft means.

8. Propulsion unit in accordance with claim 7, wherein the motor is an electric motor.

9. Propulsion unit in accordance with claim 8, wherein the propulsive means includes a propeller.

10. Propulsion unit in accordance with claim 9, further comprising angular gear means connected to said drive shaft means, and propeller shaft means having a horizontal axis of rotation connected to the angular gear means, said propeller being mounted on said propeller shaft means.

11. Propulsion unit in accordance with claim 10, further comprising a propeller housing with nozzle-shaped inner contour in which said propeller is disposed.

12. Propulsion unit in accordance with claim 11, further comprising a tube mounted in circumscribing relationship to said drive shaft means, and having a lower end connected to the propeller housing to form a chamber therebetween, said angular gear means being connected between said propeller shaft and said drive shaft means within said chamber.

13. Propulsion unit in accordance with claim 12, wherein the tube is mounted rotatably relative to the cylindrical housing whereby the propulsive means is a rudder propeller, with which the speed of travel and the direction of travel of the watercraft can be determined.

14. Propulsion unit in accordance with claim 13, further comprising radial arm means having inner ends and outer ends, said outer ends being rigidly, but detachably connected to the cylindrical housing and rotary bearings mounted between the inner ends of the radial arm means and the tube.

15. Propulsion unit in accordance with claim 14, further comprising a fluid tight disk on which said radial arm means is mounted for separating the space located under the disk, which can be filled with fluid, from a fluid-free space located above the disk.

16. Propulsion unit in accordance with claim 15, wherein the vertical axle journal and the cylindrical housing have parallel axes.

17. Propulsion unit in accordance with claim 16, wherein the cylindrical housing has a constant diameter from bottom to top.

18. Propulsion unit in accordance with claim 17, further comprising cover means mounted on the cylindrical housing at the top end, which cover can be removed and wherein the motor, the drive shaft means, and the propulsive means can be removed from the cylindrical housing in the upward direction.

19. Propulsion unit in accordance with claim 18, further comprising rollers mounted between the housing-side ends of the radial arm means and the inner wall of the cylindrical housing.

20. Propulsion unit in accordance with claim 19, further comprising a closing plate mounted on the cylindrical housing, for sealing the cylindrical housing when the propulsive means has been withdrawn into the cylindrical housing.

* * * * *